US008824718B2

(12) United States Patent
Held

(10) Patent No.: US 8,824,718 B2
(45) Date of Patent: Sep. 2, 2014

(54) LOUDSPEAKER APPARATUS WITH CIRCUMFERENTIAL, FUNNEL-LIKE SOUND OUTLET OPENING

(76) Inventor: Frank Held, Regensburg (DE)

( * ) Notice: Subject to any disclaimer, the term of this patent is extended or adjusted under 35 U.S.C. 154(b) by 0 days.

(21) Appl. No.: 13/639,364

(22) PCT Filed: May 26, 2011

(86) PCT No.: PCT/EP2011/058615

§ 371 (c)(1),
(2), (4) Date: Oct. 4, 2012

(87) PCT Pub. No.: WO2011/147902

PCT Pub. Date: Dec. 1, 2011

(65) Prior Publication Data

US 2013/0058518 A1 Mar. 7, 2013

(30) Foreign Application Priority Data

May 28, 2010 (DE) ..... 10 2010 021 879

(51) Int. Cl.

| | |
|---|---|
| ***H04R 25/00*** | (2006.01) |
| ***H04R 1/34*** | (2006.01) |
| ***G10K 9/00*** | (2006.01) |
| *H04R 1/30* | (2006.01) |

(52) U.S. Cl.

CPC *H04R 1/345* (2013.01); *H04R 1/30* (2013.01); *G10K 9/00* (2013.01)

USPC ..... 381/340; 381/337; 381/341

(58) Field of Classification Search

USPC ..... 381/337, 338, 339, 340, 341, 342, 343; 181/151, 152, 159, 177, 192, 193, 194, 181/195

See application file for complete search history.

(56) References Cited

U.S. PATENT DOCUMENTS

| | | | | |
|---|---|---|---|---|
| 1,943,499 | A | 1/1934 | Williams | 181/27 |
| 4,381,831 | A | 5/1983 | Putnam | 181/152 |
| 5,432,860 | A * | 7/1995 | Kasajima et al. | 381/349 |
| 5,793,000 | A * | 8/1998 | Sabato et al. | 181/152 |
| 2002/0150270 | A1 | 10/2002 | Werner | 381/342 |

FOREIGN PATENT DOCUMENTS

| | | | |
|---|---|---|---|
| DE | 4108409 | 8/1991 | H04R 1/30 |
| DE | 19849401 | 5/1999 | H04R 1/34 |
| DE | 102007019450 | 10/2008 | G10K 11/02 |
| GB | 248061 | 2/1926 | |
| GB | 2302231 | 1/1997 | H04R 1/30 |
| GB | 2341742 | 3/2000 | G10K 11/172 |
| GB | 2459338 | 10/2009 | H04R 1/32 |
| WO | WO2007109075 | 9/2007 | H04R 9/04 |

OTHER PUBLICATIONS

International Search Report issued for corresponding application No. PCT/EP2011/058615, dated Aug. 5, 2011 (6 pgs).

* cited by examiner

*Primary Examiner* — Huyen D Le
(74) *Attorney, Agent, or Firm* — Hayes Soloway P.C.

(57) ABSTRACT

A loudspeaker apparatus has at least one sound generator wherein an at least partially sound-conducting channel is arranged in a sound radiation direction of the sound generator and is suitable for directing sound emerging from the sound generator along the course of the sound-conducting channel such that the sound emerges from the loudspeaker apparatus at a second end of the sound-conducting channel, which end is in the form of a sound outlet opening, at a radiation angle which defined by the sound outlet opening.

20 Claims, 7 Drawing Sheets

LOUDSPEAKER APPARATUS WITH CIRCUMFERENTIAL, FUNNEL-LIKE SOUND OUTLET OPENING

BACKGROUND OF THE INVENTION

The invention relates to a loudspeaker apparatus which comprises at least one sound generation means, a channel which conducts sound at least in part being arranged in one sound radiation direction of the sound generation means, which channel is suitable for directing sound emerging from the sound generation means along the course of the sound-conducting channel in such a way that the sound emerges from the loudspeaker apparatus at a second end—designed in the form of a sound outlet opening—of the sound-conducting channel at a radiation angle defined by the sound outlet opening.

Loudspeaker apparatus which radiate the generated sound omnidirectionally have long been prior art. In this case a mainly tapered sound-reflecting medium is positioned in front of the sound generation unit in such a way that the radiated sound is reflected by the walls of the taper and is radiated at a large angle radially around the axis, the axis of the taper. Technical use is made of this in sirens and alarm units for example.

Corresponding apparatus, however, are also advantageous for the transmission of language and music, for example in the broadcasting of sound to large spaces, halls, stadia, shopping centres and the like. Accordingly, for example, it is provided in the case of the subject matter of the publication DE 41 08 409 A1 that an amplification of the sound pressure is achieved at the same time with the omnidirectional radiation of the sound. Accordingly, the sound-conducting channels are enlarged in the manner of a horn. This apparatus is therefore also referred to as a ring horn.

In the same way, the aim of the publication DE 198 49 401 A1 is to improve the efficiency of omnidirectionally radiating loudspeaker apparatus in order to be able to supply large areas in an acoustic manner even with a low amplifier power. A sound channel widened in the manner of a horn is described in this publication as well.

Similar apparatus were already developed at the beginning of the 20th century. In this way, for example, an omnidirectionally radiating horn has likewise been disclosed in the publication U.S. Pat. No. 1,943,499. In this publication embodiments are additionally described in which one or more coils are incorporated in the sound-conducting channel in order to enlarge the volume of the horn and thus additionally to increase the sound pressure. The lengthening achieved in this way additionally increases the sound pressure. In addition, depending upon the design of the coils and the radii of curvature it is possible for a preferred sound radiation direction to be specified.

A further example of an omnidirectionally radiating loudspeaker is disclosed in GB 248 061. The subject matter of the apparatus disclosed in it is a loudspeaker, in which the sound radiated by the latter—after the sound pressure has been amplified by a horn—encounters a mushroom-like apparatus which deflects the sound omnidirectionally.

A similar principle is disclosed in DE 10 2007 019 450. The subject matter of this publication is an omnidirectionally radiating and receiving acoustic horn. In the case of this acoustic horn too, a horn-like funnel neck is provided, at the thinner end of which the microphone or the loudspeaker can be arranged. The further end of the funnel neck has attached to it a taper-like solid body which together with the lower solid body forms a sound channel through which the sound is transmitted in such a way that it can emerge radially out of the apparatus.

The low sound pressure produced by the sound radiation over virtually the entire periphery of the apparatus is encountered in a specified direction by these apparatus according to the prior art with horn-like designs of the sound-conducting channel. Although this has positive effects for example on the sound pressure and the efficiency, it gives rise to various drawbacks which preclude an application of loudspeaker systems of this type in the hi-fi sector. In this way, for example, the usually high direction factor of horn loudspeakers counteracts the intention of an omnidirectionally radiating loudspeaker with virtually equal tone quality and volume over the entire space. On account of reflection inside the horn, it is possible for distortions and phase cancellations to occur and for the signal run time to be prolonged. This reduced fidelity in reproduction is undesired in the hi-fi sector. In the same way, the narrow band width and, in particular, the excessively high lower cut-off frequency in the case of an acceptable structural size preclude use in the private sector.

Modern loudspeakers and amplifiers already have performance characteristics which do not rely upon the high degree of efficiency of horn loudspeakers in particular in the case of the broadcasting of sound to relatively small spaces. Tone production as faithful as possible to the original is in fact a key requirement.

The object of the present invention is thus to provide an omnidirectionally radiating loudspeaker apparatus which avoids the drawbacks of sound-conducting channels shaped in the manner of a horn and which thus generates an improved acoustic result.

SUMMARY OF THE INVENTION

This object is attained according to the invention by a loudspeaker apparatus which comprises at least one sound generation means, a channel which conducts sound at least in part being arranged in one sound radiation direction of the sound generation means, which channel is suitable for directing sound emerging from the sound generation means along the course of the sound-conducting channel in such a way that the sound emerges from the loudspeaker apparatus at a second end—designed in the form of a sound outlet opening—of the sound-conducting channel at a radiation angle defined by the sound outlet opening, and the sound-conducting channel having on an inner wall a mainly sound-reflecting material in some portions and a mainly sound-absorbing material in other portions, or is made mainly sound-reflecting in some portions and mainly sound-absorbing in other portions in a corresponding manner.

The portion-wise arrangement of mainly sound-reflecting and mainly sound-absorbing materials inside the channel serves to reduce sound reflections. In this way, reflections between the sound-reflecting and sound-absorbing portions of the sound-conducting channel are reduced. This leads to the possibility of the extended signal run times which occur on account of multiple reflections inside the channel and the distortions and phase cancellations which result from them being minimized, and this in turn leads to an improved and clearer sound pattern.

In addition, the object is attained according to the invention by a loudspeaker apparatus which comprises at least one sound generation means, a channel which conducts sound at least in part being arranged in one sound radiation direction of the sound generation means, which channel is suitable for directing sound emerging from the sound generation means along the course of the sound-conducting channel in such a way that the sound emerges from the loudspeaker apparatus at a second end—designed in the form of a sound outlet opening—of the sound-conducting channel at a radiation angle defined by the sound outlet opening, and a cross-section of the sound-conducting channel being made substantially constant over at least 50% of the length, preferably over at least 70% of the length, and in a particularly preferred manner over at least 80% of the length of the sound-conducting channel.

On account of this parallel design of the limits of the sound-conducting channel the horn-like design is avoided and the sound-conducting channel is used only for the deflection of the sound and for its radial radiation at the same time as the tone quality is as great as possible. The tone-altering properties of horn-like channels are substantially avoided. A face situated radially on the inside is referred to in this case as the inner limit of the sound-conducting channel and a face situated radially on the outside is referred to as the outer limit, these faces limiting the sound-conducting channel along its course. In this context the expression "cross-section remaining substantially constant" means that the distance between the face situated radially on the inside and the face situated radially on the outside remains substantially constant along the course of the sound-conducting channel. Deviations of less than 10% (with respect to the change in the distance of the face situated radially on the inside and the face situated radially on the outside along the course in relation to the length of the channel), preferably of less than 5%, more preferably of less than 2%, and in a particularly preferred manner of less than 1%, however, are possible.

Apart from the sound inlet opening and the sound outlet opening the sound-conducting channel is closed. Areas which are made mainly sound-absorbing, however, can have openings through which the sound can pass to sound-absorbing media or spaces situated to the rear.

In this case the cross-section of the sound-conducting channel is constant over as large an area as possible in order to avoid the drawbacks of horn-like channels. The end of the channel can have optionally attached to it, however, a sound outlet opening, which has a cross-section differing from the cross-section of the sound-conducting channel and which thus defines a special opening angle for the sound outlet. Enlargements or narrowings are possible in this area. In the same way it is possible to deviate from the constant cross-section in the area of the sound inlet opening. Since the point at which the inner limit of the sound-conducting channel begins and which represents the tip of the taper-like shape which is formed by the face situated radially on the inside is preferably not in direct contact directly with the sound generation means, in this area of the sound inlet opening the width of the sound-conducting channel is defined only by the face situated radially on the outside.

Sharp bends, narrow radii of curvature, loops and similar patterns of the sound-conducting channel have an adverse effect upon the tone quality. In a particularly preferred embodiment of the loudspeaker apparatus, therefore, the upper and lower limits of the sound-conducting channel substantially follow in each case the shape of a curve which corresponds to a portion, preferably a quarter, of the periphery of a circle or the periphery of an ellipse. This pattern has been found to be particularly advantageous since for example sound reflections inside the channel can be minimized as a result. A horizontal orientation of the loudspeaker and thus a mainly vertical sound radiation into one opening of the sound-conducting channel in combination with sound-conducting channels, the pattern of which corresponds exactly to a quarter of the periphery of a circle or the periphery of an ellipse, suggest themselves if a substantially horizontal radiation of the sound is desired. This is advantageous for example if the loudspeaker apparatus is arranged at the level of the receiver or the hearer respectively.

If the loudspeaker apparatus is arranged at a different level, however, patterns of the sound-conducting channel, which do not correspond to a quarter of the periphery of a circle or the periphery of an ellipse, but are greater or smaller, suggest themselves. In this way, in the case of a suspended ceiling speaker for example, a sound radiation directed slightly downwards is desired, and thus the sound-conducting channel is if possible shorter than exactly a quarter of the periphery of a circle or the periphery of an ellipse. In the case of sound generation means which radiate upwards and which can be used for example on masts for the broadcasting of sound to large areas and spaces, the sound-conducting channel is ideally longer than exactly a quarter of the periphery of a circle or the periphery of an ellipse in order to deflect the sound in the direction of the ground.

The length of the sound-conducting channel can be selected as desired and can thus be adapted to the respective conditions of the surroundings. In this way, for example, in areas in which the hearer is situated relatively close to the loudspeaker apparatus, such as for example in a car hi-fi and a home entertainment system, shorter sound-conducting channels are sufficient and advantageous for a homogeneous sound pattern. For the broadcasting of sound over larger areas, stadia, halls or the like, however, it is advantageous for loudspeaker apparatus with a large radius and thus also long sound-conducting channels to be used. Loudspeaker apparatus of this type can also be combined to form line array systems. It is also possible for loudspeaker apparatus with sound-conducting channels of different length to be combined and for radiation angles different in this way to be broadcast by way of sound-conducting channels of different length.

In a particularly preferred embodiment of the loudspeaker apparatus the mainly sound-reflecting material is arranged inside the sound-conducting channel on a face situated radially on the inside and the mainly sound-absorbing material is arranged inside the sound-conducting channel on a face situated radially on the outside. On account of this variant of embodiment it is made possible that, although the sound is reflected in the direction of the sound outlet opening of the channel by the mainly sound-reflecting material on the face situated radially on the inside, multiple reflections inside the channel are minimized.

Both the mainly sound-reflecting material and the mainly sound-absorbing material in this case can completely cover the respective area or can be arranged only in specified portions on the respective area, for example in portions with an especially narrow curve radius. Both the mainly sound-reflecting material and the mainly sound-absorbing material can be selected in such a way that they have the respective property only for specified frequencies or frequency ranges. By means of a suitable distribution of materials mainly sound-absorbing for different frequency ranges for example along the channel, it is possible to react to particularly critical sound reflections in specified areas.

In a special embodiment of the loudspeaker apparatus a sound inlet opening of the sound-conducting channel has an internal diameter which corresponds substantially to an external diameter of the loudspeaker, and the sound inlet opening is in indirect contact with the loudspeaker. In this context, indirect contact means that the sound inlet opening of the sound-conducting channel is connected by way of a sound-absorbing element, such as for example by way of a rubber ring, to the baffle board of the loudspeaker, but is substantially decoupled from it. On account of this embodiment, sound which is emitted by the loudspeaker passes directly through the sound inlet opening into the sound-conducting channel. The flush attachment of the channel to the outer limit of the loudspeaker has the effect that sound waves can pass into the sound-conducting channel without further obstruction. Dead volumes, which would be formed with a sound inlet opening larger than the external diameter of the loudspeaker, are avoided. At the same time, sound is prevented from being emitted by the loudspeaker directly onto an outer wall of the sound-conducting channel, where undesired reflections would occur.

In some cases, however, it is advisable to filter out sound waves which are emitted by the loudspeaker and which strike an outer wall of the sound-conducting channel at a particularly steep angle. Since these sound waves would be reflected substantially more frequently inside the sound-conducting channel between the outer walls thereof, this would lead to lengthened signal run times. This can be prevented for example by the sound inlet opening being situated at a distance from the loudspeaker. The area situated between them can be open for example or can be provided with a mainly sound-absorbing material.

Omnidirectionally radiating loudspeaker apparatus are to be used in particular to ensure as good a hearing experience everywhere in a room for a hearer. It is therefore advisable for sound to be emitted horizontally to the surroundings from the loudspeaker apparatus through a sound outlet opening at as large an angle as possible. In order to ensure this, in a preferred embodiment of the loudspeaker apparatus a loudspeaker which comprises the sound generation means and which radiates generated sound vertically upwards or downwards at least in part is arranged substantially horizontally. The radiated sound can thus be deflected through the substantial rotationally symmetrical sound-conducting channel, so that it leaves the loudspeaker apparatus substantially horizontally radially. As already described above, depending upon the variant of embodiment, radiation angles are also possible which deviate from the substantially horizontal radiation direction. In this case too, however, a horizontal position of the loudspeaker and/or a vertical sound radiation direction of the loudspeaker is or are possible.

In a further preferred embodiment of the loudspeaker apparatus the loudspeaker apparatus has at least two loudspeakers, at least one radiating the sound vertically upwards at least in part and at least one other radiating the sound vertically downwards at least in part and preferably at least two loudspeakers having a sound-conducting channel in the sound radiation direction of the sound generation means. On account of an embodiment of this type it is possible for the annular sound outlet openings of two loudspeakers to be arranged closely beside each other. If for example the two loudspeakers are a woofer and a tweeter, it is possible for the sound sources, namely the sound outlet openings, perceived by a hearer, to be arranged closely beside each other, so that in an ideal case only one sound source can be identified by the hearer and it is not possible to differentiate between a sound source for high tones and one for mid/bass tones. In this way, a highly homogeneous sound pattern is produced.

If the sound outlet opening is situated at the level of the hearer it is preferable for the loudspeaker apparatus to be designed in such a way that at least one sound-conducting channel is made curved in such a way that sound emerges out of the sound outlet opening substantial horizontally. This embodiment is advantageous for example if the loudspeaker apparatus is part of a floor-standing speaker (stand box) or possibly also a shelf speaker.

If a loudspeaker apparatus of this type is operated not at the level of the hearer but for example as a ceiling speaker, it is sometimes advantageous, as already described above, to deviate from this embodiment. If for example the variant of embodiment with two loudspeakers as ceiling speakers is used, this may be an example of a guidance of the sound-conducting channel, which guidance corresponds to a curve which constitutes a portion larger than a quarter of the periphery of a circle or the periphery of an ellipse. In order to emit the sound in a substantially tapered manner downwards through the sound outlet opening, the channel of the loudspeaker orientated downwards should be smaller than a quarter of the periphery of a circle or the periphery of an ellipse. In order to ensure the same emergence angle out of the sound outlet opening in the case of sound generation means orientated upwards, however, a longer or more greatly curved channel which is larger than a quarter of the periphery of a circle or the periphery of an ellipse is necessary in this case.

In a preferred embodiment of the loudspeaker apparatus at least one sound-conducting channel is designed in such a way that sound emerges radially out of the sound outlet opening at an angle of at least 5°, preferably at least 150°, more preferably at least 180°, in a particularly preferred manner at least 230° and in a particularly preferred manner at least 270°. In this case the sound outlet opening is opened substantially over the entire periphery.

In this way, the sound-conducting channel of the loudspeaker apparatus is designed in such a way that sound emerges radially out of the sound outlet opening substantially over the entire periphery, in which case it is possible for parts of the loudspeaker apparatus, which obstruct or alter a direct emergence of the sound, to be arranged in the sound-conducting channel and/or in a path which the sound covers after emerging out of the sound outlet opening. These parts of the loudspeaker apparatus which are arranged in the channel, in the sound outlet opening or in the sound radiation direction can be for example stabilizing elements which hold the taper-like element which constitutes the limit—situated radially on the inside—of the channel. In addition, other elements such as cable guides or the like can extend through the channel or the sound outlet opening or they can be arranged in the sound radiation direction. The cable guides serve for example to supply further loudspeakers or sound generation means. These can be current cables, fibre optic cables or other suitable cables. It is also possible for cable guides and stabilizing elements to be combined to form common elements.

In the same way, it is possible for sound-absorbing materials to be incorporated into the sound-conducting channel, into the sound outlet opening or in the sound radiation direction. On account of sound-absorbing elements of this type it is possible, with the simultaneous operation of a plurality of loudspeaker apparatus of this type, to reduce negative sound effects which occur between the loudspeaker apparatus as a result of the sound waves possibly converging in a phase-shifted manner. In this way, for example, in a pair-wise operation of loudspeaker apparatus, it is possible to contain an amplitude modulation such as for example a frequency cancellation in the area between the loudspeakers. The particularly small angle of at least 5° in which the sound emerges from the sound outlet opening is preferably to be derived from the purposeful incorporation of sound-absorbing materials into the sound-conducting channel.

On account of the sound radiated mainly radially and possibly horizontally, particularly when using a loudspeaker apparatus according to the invention as a ceiling speaker it can happen that directly below the loudspeaker the radiated sound cannot be detected at all, or only very faintly and thus unintelligibly. In a preferred embodiment of the loudspeaker apparatus the face—situated radially on the inside—of the sound-conducting channel therefore has means which permit the passage of sound at least in part. In this way it is possible for sound radiated by the sound generation means not to be deflected completely through the sound-conducting channel and to be radiated radially, but to pass through the face—situated radially on the inside—of the sound-conducting channel and therefore to be capable of being detected directly in the sound radiation direction of the sound generation means. In the case of a ceiling speaker it is thus possible for the sound radiated by the sound generation means also to be detected directly below the loudspeaker apparatus.

Possible variants of modifying the face—situated radially on the inside—of the sound-conducting channel, which allow this, are for example the perforation or cutting of the tip of the face—designed in the manner of a taper and situated radially on the inside—of the sound-conducting channel.

As already described, it is advantageous for the sound-conducting channel to have the same cross-section over the greater part of its length, i.e. it is therefore neither widened nor narrowed. In order to be able to influence the radiation angle, however, it is possible for the end of the sound-conducting channel to have attached to it a sound outlet opening, the opening of which is made widened or narrowed with respect to the sound-conducting channel.

A preferred embodiment of the loudspeaker apparatus is therefore characterized in that the sound outlet opening is made widened with respect to the sound-conducting channel.

In a further preferred embodiment of the loudspeaker apparatus the sound-conducting channel is arranged inside a loudspeaker housing and the at least one sound outlet opening preferably constitutes an opening of the housing. An arrangement of this type makes it possible to incorporate the loudspeaker apparatus in a corresponding housing and thus further to influence both the design and the sound properties. It is thus possible for loudspeaker apparatus according to the invention to be incorporated for example in floor-stand or shelf speaker housings. In the same way, it is also possible, however, for the loudspeaker apparatus to be provided with suitable holding elements and to be incorporated in suitably prepared receiving apparatus. This may be desired for example if a loudspeaker apparatus of this type is provided as a constituent part of architectural designs. In a very simple embodiment this can be used as ceiling speakers in public buildings such as railway stations, shopping centres, airports, offices, covered markets, stadia, sports halls, concert halls and multiple-purpose halls and the like. In some particular cases, however, it is also provided that a loudspeaker apparatus of this type is incorporated in the form of an integral component part in a structure. This is desired for example when outstanding sound properties are required. This is desired for example in concert halls, theatres, opera houses, special cinemas and the like, in which special effects influencing the sound and/or the architecture occur as a result of the precise positioning of loudspeaker apparatus of this type and their interaction with the architectural surroundings.

By means of the preferred embodiment in which the sound-conducting channel has the same cross-section over the greater part of its length, i.e. is neither widened nor narrowed, and is not altered with respect to the shape of the cross-section and therefore does not have the sound pressure amplification effects of horn-type loudspeakers, it may be necessary for the sound pressure to be increased by other measures. In this way, in a preferred embodiment of the loudspeaker apparatus it is provided that the sound-conducting channel has sound pressure amplification means. These can be for example elements which are introduced into the sound-conducting channel. By way of example, it is possible for cams, rings, specified convexities, recesses or the like in the interior of the sound-conducting channel to have sound pressure amplification effects.

In principle, any materials which have the desired function with respect to the acoustic properties are suitable as the materials to be used in a loudspeaker apparatus according to the invention. In a preferred embodiment of the loudspeaker apparatus, therefore, the sound-conducting channel is produced from metal, glass, wood, stone, plastics material and/or Perspex. When adjusting the use of the different materials both sound properties and optical properties and design can be adjusted to one another. By means of such an adjustment of the materials used, an implementation of the loudspeaker apparatus is possible which combines sound properties, design and costs of materials in accordance with the wishes of the customer.

A further essential aspect is the use of a loudspeaker apparatus according to the invention in which the loudspeaker apparatus is used for broadcasting sound to large areas or buildings such as for example stadia, halls, large rooms, shopping centres and the like, and/or for broadcasting sound inside means of transport such as for example boats, ships, trains, underground systems, urban railways, aircraft, buses, private passenger cars (car hi-fi) and the like, and/or for distributing commercial information such as for example advertising, news and the like, and/or in medical appliances and/or in loudspeakers for the hi-fi sector and/or the professional audio sector and/or in architectural objects.

Possible medical appliances in which a loudspeaker apparatus according to the invention can be used are appliances for combating tinnitus, sonographic appliances, appliances for hearing tests and other medical appliances which act upon the patient with sound.

The possibility of a loudspeaker apparatus according to the invention radiating sound omnidirectionally makes combinations with other loudspeakers which radiate omnidirectionally advisable. Depending upon the respective frequency ranges it may be advantageous for example for a loudspeaker apparatus according to the invention in the form of a woofer to be combined with a plasma tweeter. In addition, combinations with other loudspeakers which radiate omnidirectionally such as ion loudspeakers are possible. A combination with bending wave transducers can likewise be advantageous.

BRIEF DESCRIPTION OF THE DRAWINGS

Further advantages, aims and properties of the present invention are explained with reference to the following description of the accompanying drawings, in which a loudspeaker apparatus according to the invention is illustrated by way of example. In the drawing

DETAILED DESCRIPTION OF THE INVENTION

Figure 1:
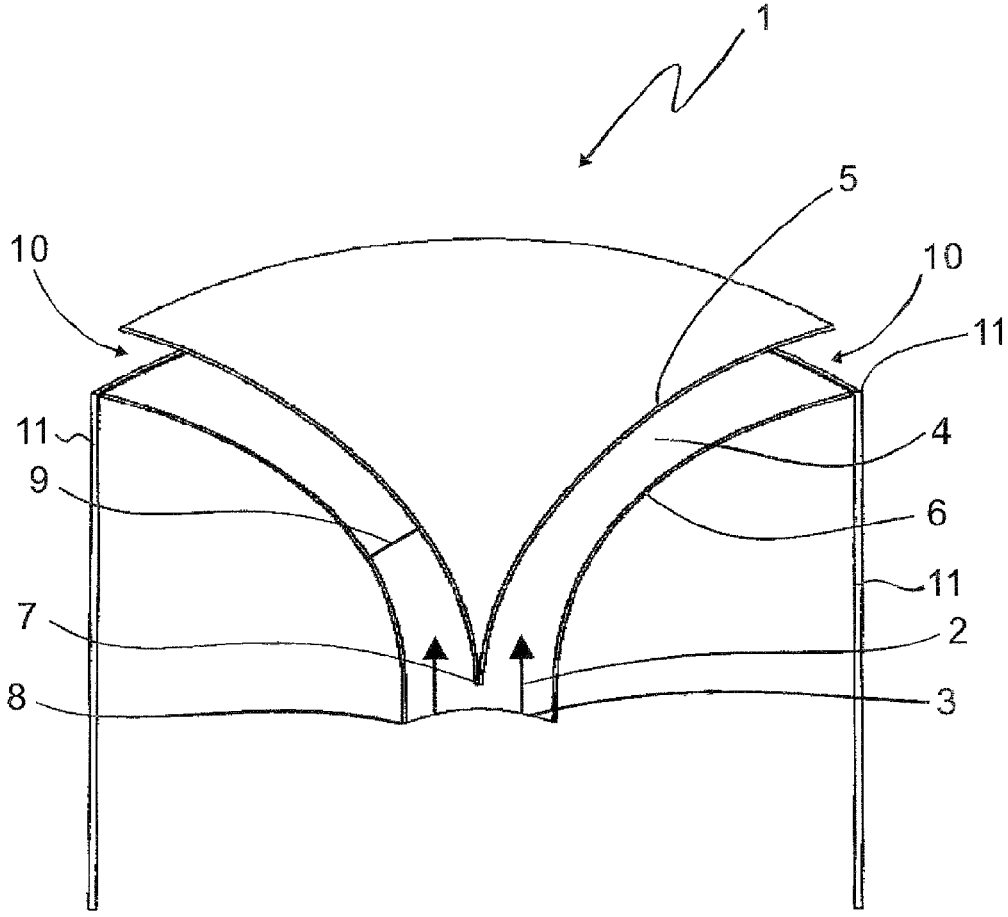
FIG. 1 is a diagrammatic side view of a loudspeaker apparatus.

FIG. 1 is a diagrammatic side view of a loudspeaker apparatus 1. In this case at least one sound-conducting channel 4, which is designed in the form of an intermediate space between a limit 5 situated radially on the inside and a limit 6 situated radially on the outside, is arranged in a sound radiation direction 2 of the sound generation means 3. The two limits 5 and 6 are designed in the form of funnels in this case. The convexity corresponds to a quarter of the periphery of a circle or the periphery of an ellipse. The limit 5 situated radially on the inside terminates in a tip 7 at the point which comes closest to the sound generation means 3. The limit 6 situated radially on the outside finishes flush with the sound generation means 3 in the region 8 which comes closest to the latter.

The convexity of the limit 5 situated radially on the inside and of a limit 6 situated radially on the outside is selected in such a way that a cross-section 9 of the sound-conducting channel 4 is made substantially constant over the length of the sound-conducting channel 4. The end 10 of the sound-conducting channel 4 remote from the sound generation means 3 constitutes a sound outlet opening 10 through which the sound can be emitted to the surroundings at a large angle radially to the sound radiation direction 2 of the sound generation means 3. Parts of the housing 11 of the loudspeaker apparatus 1 are attached to the underside of this opening which at the same time constitutes one end of the limit 6 situated radially on the outside. The stabilizing means which hold the limit 5 situated radially on the inside are not shown in this figure.

Figure 2:
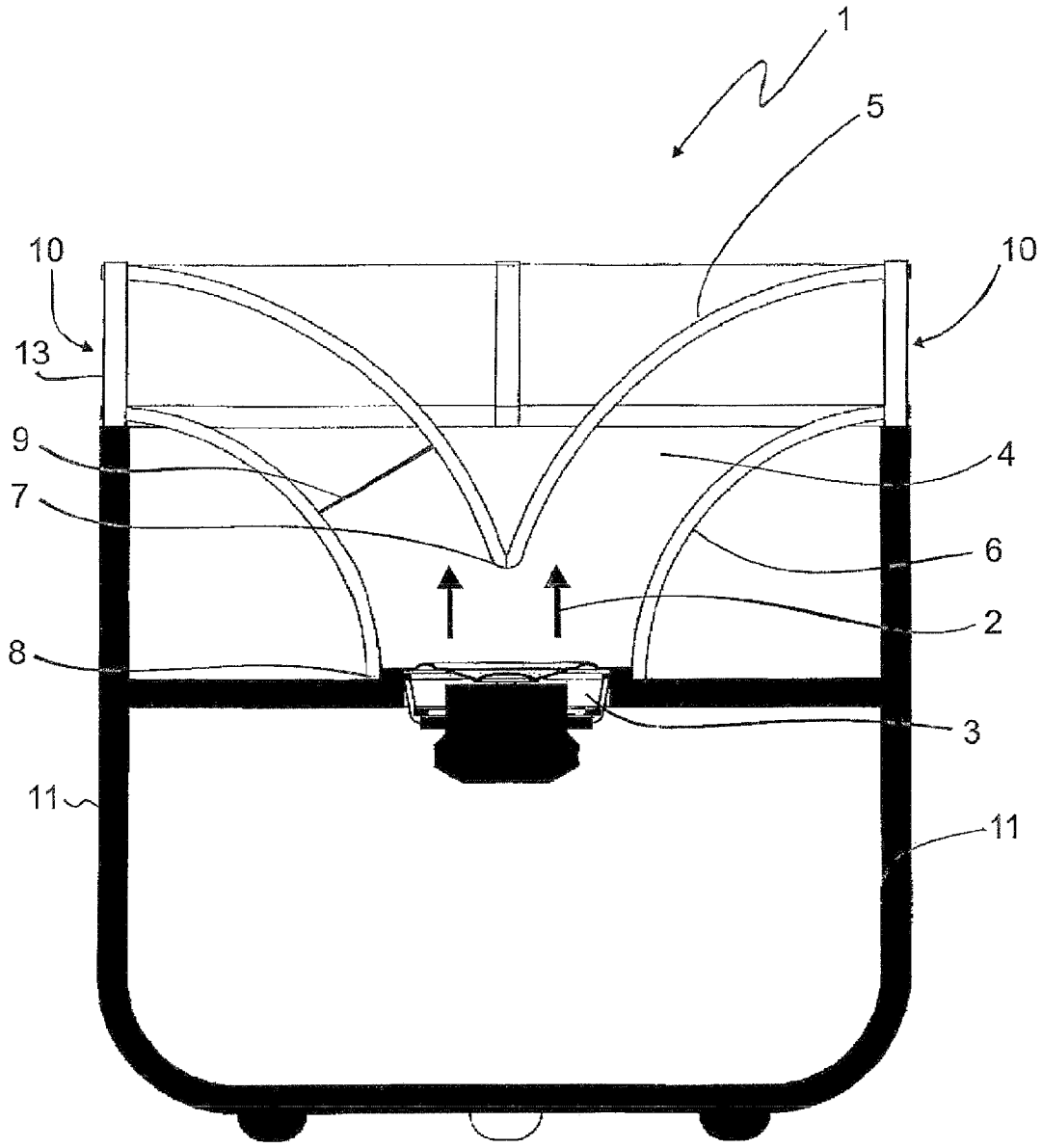
FIG. 2 is a section of a loudspeaker apparatus in a housing.

FIG. 2 is a section of a loudspeaker apparatus 1 in a housing 11. In this case too, the sound-conducting channel 4, which is situated in the sound radiation direction 2 of the sound generation means 3 and which is defined by the limit 5 situated radially on the inside and the limit 6 situated radially on the outside, is evident. The funnel-shaped limit 6 is designed in this case in such a way that the curvature or convexity corresponds to a quarter of the periphery of a circle. The convexity of the funnel-shaped limit 5 likewise corresponds to a portion of the periphery of a circle. The latter is selected to be slightly smaller, however, in order to keep the tip 7 at a slight distance from the sound generation means 3. In addition, the region 8 which comes closest to the sound generation means 3 is evident. The cross-section 9 of the sound-conducting channel 4 is substantially constant over virtually the entire length. It is clearly evident that the sound outlet opening 10 of the sound-conducting channel 4 radiates the sound emitted by the sound generation means 3 to the surroundings at an angle radially to the sound radiation direction 2 of the sound generation means 3, this angle constituting substantially the entire periphery of the loudspeaker apparatus 1. The sound outlet opening 10 extending over the entire periphery is interrupted in practice only by the stabilization means 13 shown, which hold the limit 5 situated radially on the inside.

Figure 3:
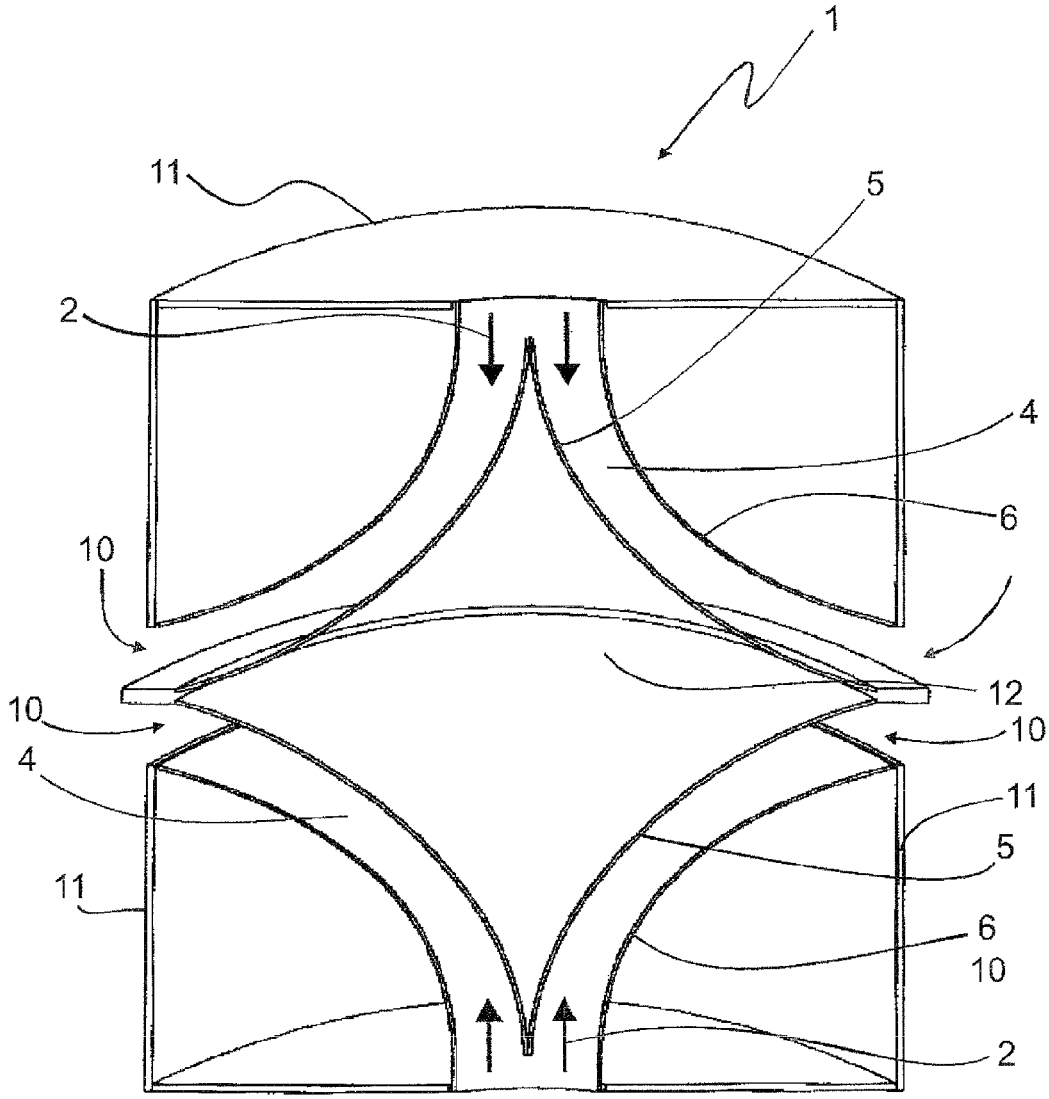
FIG. 3 is a side view of a loudspeaker apparatus in an embodiment with two sound generation means directed contrary to each other.

FIG. 3 is a side view of a loudspeaker apparatus 1 in an embodiment with two sound generation means 3 directed contrary to each other. As also in the embodiment with only one sound generation means 3, one sound-conducting channel 4 is arranged in each case in the sound radiation directions 2 of the sound generation means 3, which are defined by the limits 5 situated radially on the inside and the limits 6 situated radially on the outside. The limits 5—situated radially on the inside—of the two sound-conducting channels 4 form in this case a common body 12 which in its shape resembles a diamond in playing cards which rotates about its longitudinal axis.

In the example shown, the external radius of this body 12 and thus also of the limits 5 situated radially on the inside is approximately equal in length to that of the corresponding limits 6 situated radially on the outside. As a result, the two sound-conducting channels 4 are designed in such a way that they open into separate sound outlet openings 10. In this way, two separate sound outlet openings 10 are formed, which can be situated very closely beside each other. It is also possible, however, for the limits 5 situated radially on the inside to have an external diameter reduced with respect to the limits 6 situated radially on the outside, as a result of which the two sound-conducting channels 4 open into a common sound outlet opening 10. On account of the common use of an individual sound outlet opening 10 or the spatial proximity of the two separate sound outlet openings 10, the sound waves emerging from the loudspeaker housing 11 arrive at the hearer in such a way that despite the two sound generation means 3 he or she can locate only a single sound source. In this way for example, the separation of tweeters and woofers which is customary in the case of conventional loudspeakers and the distortions associated with it can be avoided.

In this figure the stabilization means 13 which carry the limits 5 situated radially on the inside and the body 12 respectively are again not shown. The supply lines, which are required for the energy supply and/or actuation of the upper sound generation means 3, can also be led through these stabilization means 13.

Figure 4:
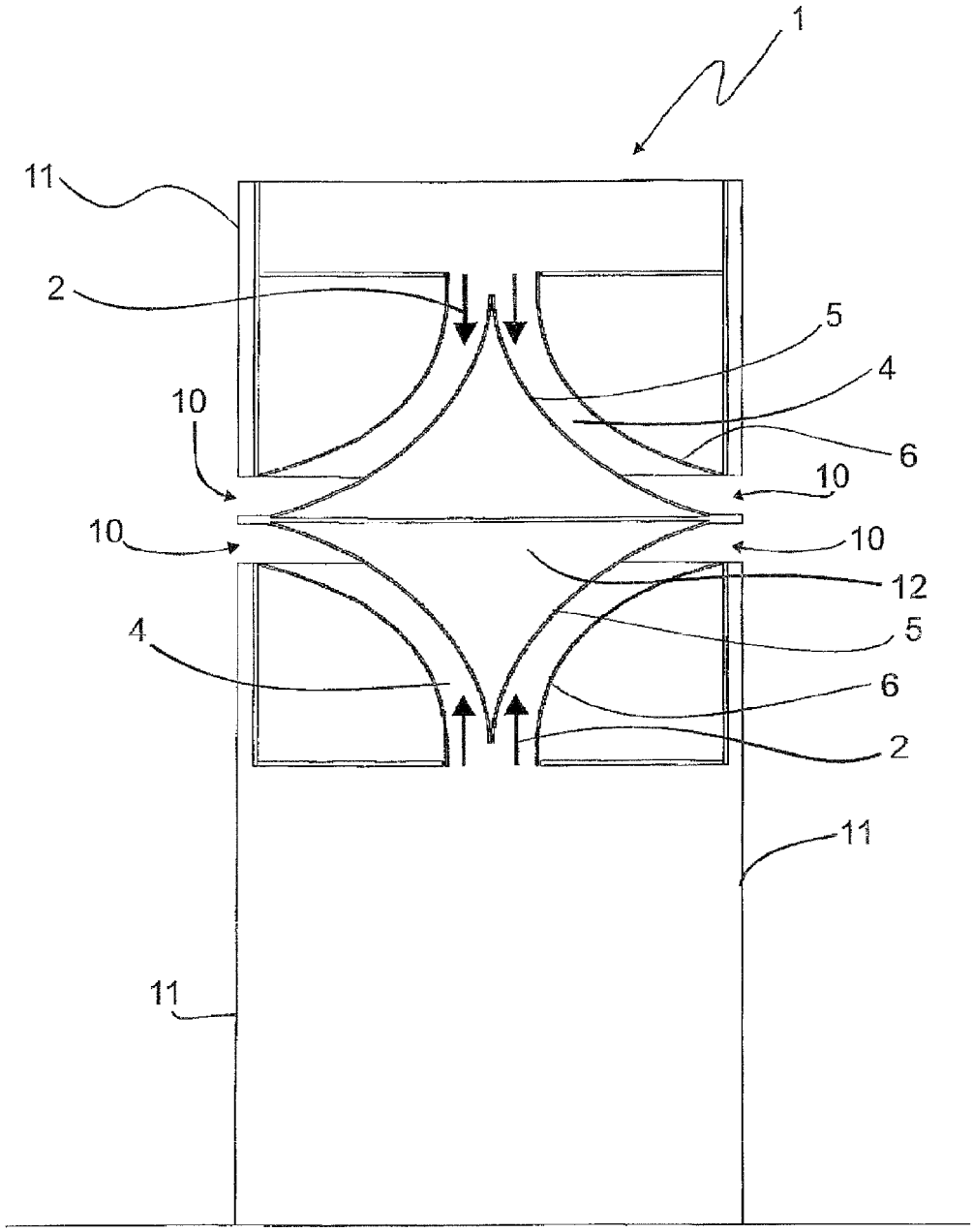
FIG. 4 is a section through a loudspeaker apparatus inside a loudspeaker housing in an embodiment with two sound generation means directed contrary to each other.

FIG. 4 is a section through a loudspeaker apparatus 1 inside a loudspeaker housing 11 in an embodiment with two sound generation means 3 directed contrary to each other. In the embodiment illustrated, two sound generation means 3 (not shown) directed contrary to each other are arranged in a loudspeaker housing 11 which in this case is designed in the form of a floor-stand speaker. Sound-conducting channels 4, which are defined by the limits 5 situated radially on the inside and the limits 6 situated radially on the outside, are arranged in each case in the sound radiation directions 2 of the sound generation means 3. As also in the example shown in FIG. 3 the external radius of the limits 5 situated radially on the inside is equal in size to that of the corresponding limits 6 situated radially on the outside, as a result of which the two sound-conducting channels 4 have no common sound outlet opening 10, but form two separate sound outlet openings 10 situated very closely beside each other in the side walls of the loudspeaker housing 11. The distance between these separate sound outlet openings 10 can be varied as desired in this case.

On account of the rotationally symmetrical embodiment of the loudspeaker apparatus 1, column-like loudspeaker housings 11 with a likewise round cross-section are particularly suitable. In some cases, however, a combination with directly radiating woofers is desirable, in order to be able to reproduce the entire range in a single loudspeaker.

A vertical arrangement—according to the invention—of the sound generation means with deflection of the sound by means of a sound-conducting channel 4 is therefore also possible in theory for woofers, but such a deflection is not suitable for particularly low frequencies on account of its physical properties. In such a case a loudspeaker apparatus 1 according to the invention can also be incorporated in square or rectangular loudspeaker housings 11.

In such a case the sound emerging out of the sound outlet opening 10 should cover a wider path in the direction of the corners of the loudspeaker housing 11 than towards a side wall of the loudspeaker housing 11. Depending upon the arrangement and distance of the sound generation means 3 and the respective sound-conducting channels 4 the paths as far as the limits of the loudspeaker housing 11 can be designed in this case in the form of separate extensions of the channel or in the form of a common extension of the channel.

Figure 5:
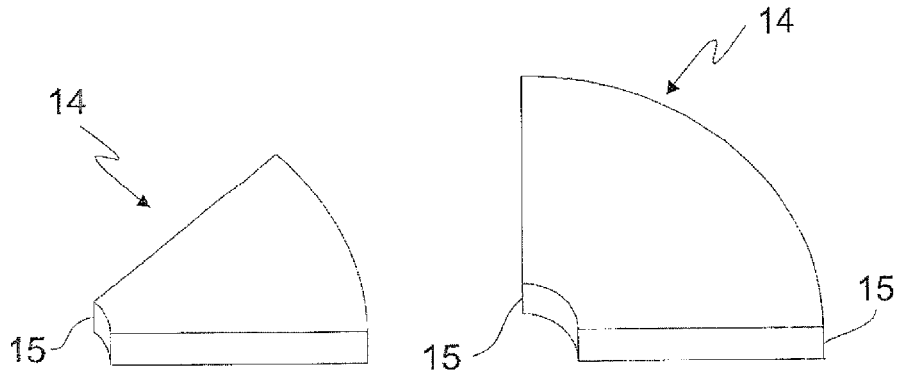
FIG. 5 is an illustration of sound-absorbing elements.

FIG. 5 is an illustration of sound-absorbing elements 14 in various embodiments which cover different angles in each case. As shown, it is possible to use sound-absorbing elements in the form of wedges or the like in different variants which cover different angles in each case. These wedge-like sound-absorbing elements have a height 15 which corresponds approximately to the cross-section 9 of the sound-conducting channel 4. Wedges of this type can 14 be introduced into the sound-conducting channel 4 or the sound-conducting channels 4 in order to eliminate a defined range of the acoustic exposure in this way and/or to reduce the intensity of the acoustic exposure in this range. As already described, this can be useful in order to prevent interference in the region directly between two loudspeaker apparatus 1 or even in order to prevent the radiation of sound directly onto a wall in the vicinity of the loudspeaker apparatus 1 and thus to minimize undesired sound reflections.

Figure 6:
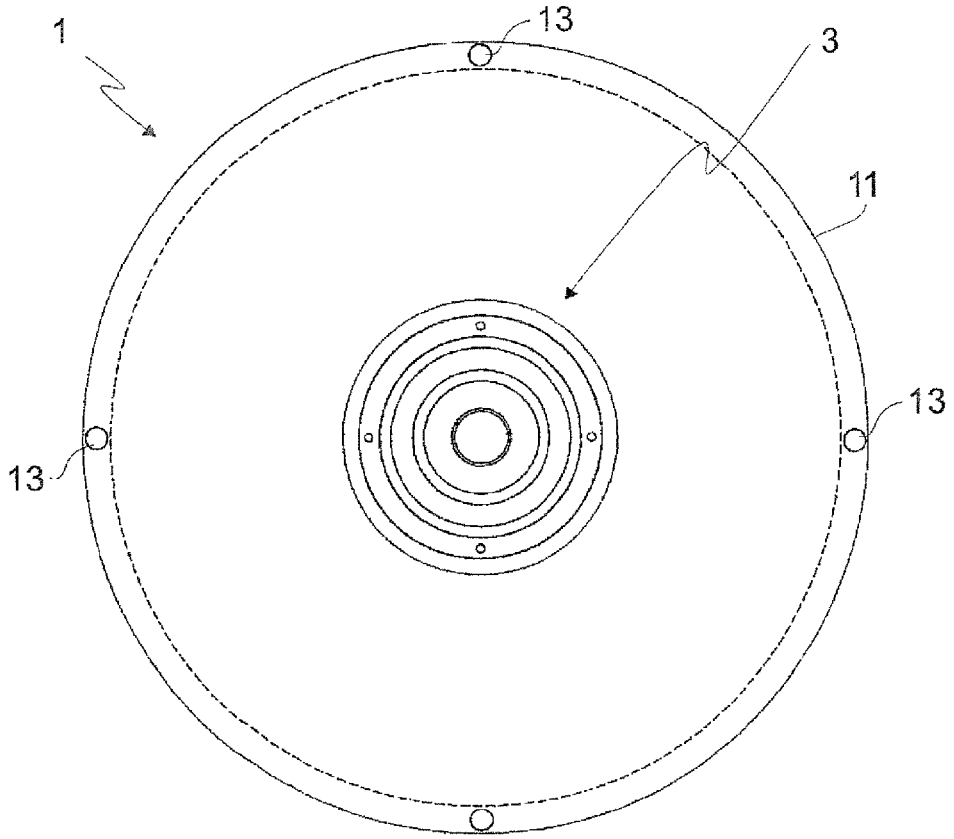
FIG. 6 is a diagrammatic view of a loudspeaker apparatus inside a loudspeaker housing with a circular base area.

FIG. 6 is a diagrammatic view of a loudspeaker apparatus 1 inside a loudspeaker housing 11 with a circular base area. In contrast to the embodiment shown in FIG. 4, in loudspeaker housings 11 with a circular base area it is not necessary for the sound, after leaving the sound-conducting channel 4 in the direction of the corners, to cover a wider path inside extensions of the channel before it leaves the loudspeaker housing 11 through the sound outlet opening 10. This results in fewer changes in sound which can occur inside the extensions of the channel. A design of this type is thus particularly advantageous. In some embodiments it is also possible for loudspeaker apparatus 1 of this type to be incorporated directly in the architecture without a special housing. This can be carried out for example by inserting a loudspeaker apparatus 1 into a wall or ceiling of a building.

In this illustration the stabilization means 13, which are arranged along the periphery of the loudspeaker apparatus 1 and which carry the limits 5 situated radially on the inside, are also evident. Since these stabilization means 13 are present in the sound outlet opening their diameter is selected to be as small as possible. In an embodiment with two sound generation means 3 directed contrary to each other, however, the cables which are used for the energy supply and/or for the actuation of a loudspeaker apparatus 1 can also be led through one or more of these stabilization means 13. In such a case stronger designs of the stabilization means 13 with the cable guide situated on the inside are also possible. These stronger stabilization means 13 are also capable of carrying the additional weight produced by the second loudspeaker apparatus 1 and of damping vibrations.

Figure 7:
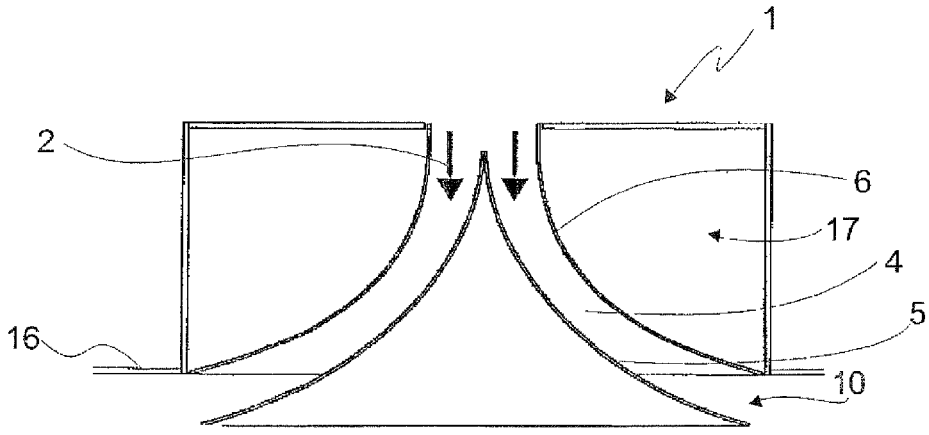
FIG. 7 is a diagrammatic side view of a loudspeaker apparatus in a suspended design, for example as a ceiling speaker.

FIG. 7 is a diagrammatic side view of a loudspeaker apparatus 1 in a suspended design, for example as a ceiling speaker. The ceiling 16 of a room, which has a recess 17 into which the loudspeaker apparatus 1 is inserted in part, is shown. The sound generation means 3 and the limit 6—present in the sound radiation direction 2 of the latter and situated radially on the outside—of the sound-conducting channel 4 are inserted completely inside the recess 17. Only the limit 5 situated radially on the inside projects with respect to the ceiling 16. In order to radiate the sound radially downwards, the arms, which the limits 5 situated radially on the inside and the limits 6 situated radially on the outside form, in this example describe an arc of a circle which does not correspond to a quarter of the periphery of a circle or the periphery of an ellipse but is smaller. This prevents the main radiation direction of the sound from extending parallel to the ceiling, but slightly radially downwards. This at the same time reduces the taper directly below the loudspeaker apparatus 1 into which the sound is not radiated directly after emerging from the sound outlet openings 10 in an embodiment of this type. In addition, sound reflections with the ceiling are also reduced.

Figure 8:
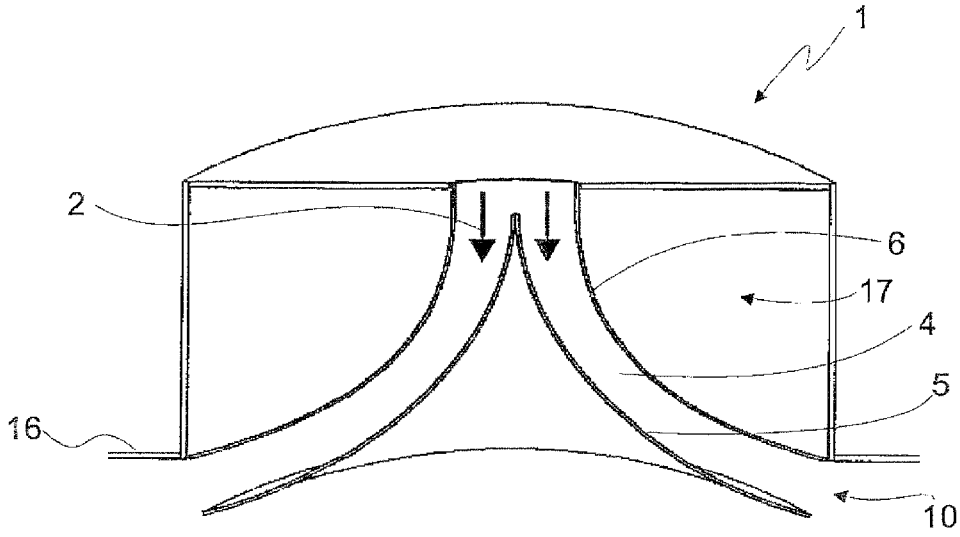
FIG. 8 is a diagrammatic side view of a further variant of embodiment of the loudspeaker apparatus in a suspended design, for example as a ceiling speaker.

FIG. 8 is a section through a loudspeaker apparatus 1 in for example as a ceiling speaker. The ceiling 16 of the room is interrupted and has a recess 17 into which the loudspeaker apparatus 1 is inserted so far that the sound generation means 3 and the limit 6—present in the sound radiation direction 2 of the latter and situated radially on the outside—of the sound-conducting channel 4 are inserted completely and are thus situated above the plane of the ceiling. The limit 5 situated radially on the inside projects downwards out of the recess 17 and thus terminates below the plane which is formed by the ceiling 16.

As also in the embodiment which is shown in FIG. 7, the arms, which the limits 5 situated radially on the inside and the limits 6—situated radially on the outside—of the sound-conducting channel 4 form, describe an arc of a circle which is smaller than a quarter of the periphery of a circle or the periphery of an ellipse. In contrast to the embodiment shown in FIG. 7, the arc of the circle is further reduced in order likewise to reduce the taper which is situated directly below the loudspeaker apparatus 1 in the sound shadow of the limit 5 situated radially on the inside and in which the sound emerging out of the sound outlet openings 10 is not audible to the desired volume, since in this region a direct sound radiation does not occur. In this way, the main radiation direction of the sound does not extend parallel to the ceiling, as a result of which sound reflections with the ceiling are reduced.

Figure 9:
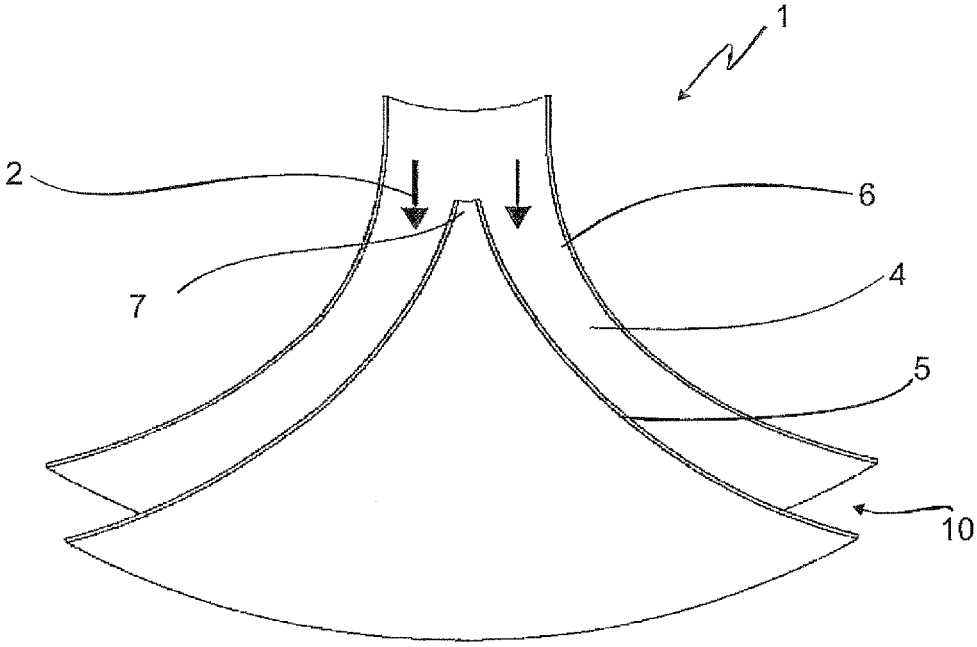
FIG. 9 is a diagrammatic side view of a loudspeaker apparatus with a cutting of the tip of the face—designed in the manner of a taper and situated radially on the inside—of the sound-conducting channel.

FIG. 9 is a diagrammatic side view of a loudspeaker apparatus 1 with a cutting of the tip 7 of the face 5—designed in the manner of a taper and situated radially on the inside—of the sound-conducting channel 4. Such a cutting of the tip 7 is possible in order, in the design in the form of a ceiling speaker and in addition to the radial radiation, to radiate parts of the sound also directly into the region below the loudspeaker which would not be adequately acted upon with sound in the case of an exclusive radial radiation in the direction of the sound outlet openings 10.

Figure 10:
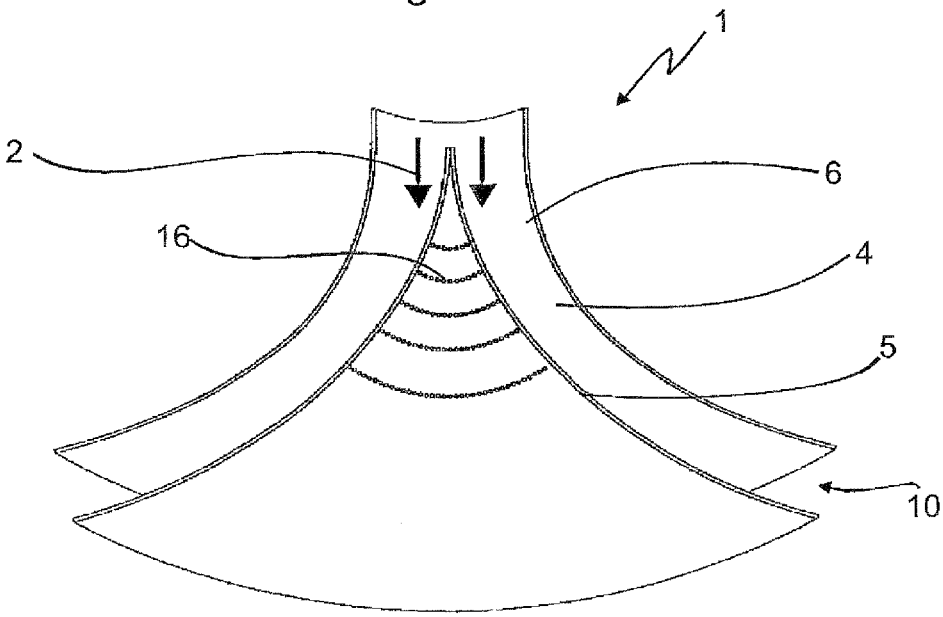
FIG. 10 is a diagrammatic side view of a loudspeaker apparatus with a perforation of the tip of the face—designed in the manner of a taper and situated radially on the inside—of the sound-conducting channel.

FIG. 10 is a diagrammatic side view of a loudspeaker apparatus 1 with a perforation 18 of the tip 7 of the face 5—designed in the manner of a taper and situated radially on the inside—of the sound-conducting channel 4. A perforation constitutes a second possibility of radiating parts of the sound in addition to the radial radiation also directly into the region below the loudspeaker which would be situated in the sound shadow of the sound outlet openings 10 without a measure of this type.

The Applicants reserve the right to claim all the features disclosed in the application documents as being essential to the invention, insofar as they are novel either individually or in combination as compared with the prior art.

LIST OF REFERENCES

1 loudspeaker apparatus
2 sound radiation direction
3 sound generation means
4 sound-conducting channel
5 limit situated radially on the inside
6 limit situated radially on the outside
7 tip
8 region which comes closest to the sound generation means
9 a cross-section
10 sound outlet opening
11 housing
12 body
13 stabilization means
14 sound-absorbing element
15 height of the sound-absorbing element
16 ceiling
17 recess
18 perforation

The invention claimed is:

1. A loudspeaker apparatus which comprises at least one sound generator, wherein a channel which conducts sound at least in part is arranged in one sound radiation direction of the sound generator, which channel is suitable for directing sound emerging from the sound generator along the course of the sound-conducting channel in such a way that the sound emerges from the loudspeaker apparatus at a second end—designed in the form of a sound outlet opening—of the sound-conducting channel at a radiation angle defined by the sound outlet opening, characterized in that the sound-conducting channel has on an inner wall a mainly sound-reflecting material in some portions and a mainly sound-absorbing material in other portions, wherein the mainly sound-reflecting material is arranged inside the sound-conducting channel on a face situated radially on the inside and the mainly sound-absorbing material is arranged inside the sound-conducting channel on a face situated radially on the outside, and a cross-section of the sound-conducting channel is made substantially constant over at least 50% of the length of the sound-conducting channel.

2. A loudspeaker apparatus according to claim 1, wherein the cross-section of the sound-conducting channel is made substantially constant over at least 70% of the length of the sound-conducting channel.

3. A loudspeaker apparatus according to claim 1, wherein at least one sound-conducting channel is designed in such a way that sound emerges radially out of the sound outlet opening at an angle of at least 5°.

4. A loudspeaker apparatus according to claim 1, wherein a limit situated radially on the inside and a limit—situated radially on the outside—of the sound-conducting channel substantially follow the shape of a curve in each case which corresponds to a portion of a circle or the periphery of an ellipse.

5. A loudspeaker apparatus according to claim 1, wherein a sound inlet opening of the sound-conducting channel has an internal diameter which corresponds substantially to an external diameter of the loudspeaker.

6. A loudspeaker apparatus according to claim 1, wherein a loudspeaker which comprises the sound generator is arranged substantial horizontally and radiates generated sound vertically upwards or downwards at least in part.

7. A loudspeaker apparatus according to claim 1, wherein the loudspeaker apparatus has at least two loudspeakers, wherein at least one radiates the sound vertically upwards at least in part and at least one other radiates the sound vertically downwards at least in part.

8. A loudspeaker apparatus according to claim 1, wherein at least one sound-conducting channel is made curved in such a way that sound emerges out of the sound outlet opening substantially horizontally.

9. A loudspeaker apparatus according to claim 1, wherein the face—situated radially on the inside—of the sound-conducting channel has means which permit the passage of sound at least in part.

10. A loudspeaker apparatus according to claim 1, wherein the sound outlet opening is made widened with respect to the sound-conducting channel.

11. A loudspeaker apparatus according to claim 1, wherein the sound-conducting channel is arranged inside a loudspeaker housing.

12. A loudspeaker apparatus according to claim 1, wherein the sound-conducting channel is produced from metal, glass, stone, wood, plastics material and/or Perspex.

13. Use of a loudspeaker apparatus according to claim 1, wherein the loudspeaker apparatus is used for broadcasting sound to large areas or buildings, and/or for broadcasting sound inside transport systems, and/or for distributing commercial information, and/or in medical appliances and/or in loudspeakers for the hi-fi sector and/or the professional audio sector and/or in architectural objects.

14. A loudspeaker apparatus according to claim 1, wherein the cross-section of the sound-conducting channel is made substantially constant over at least 80% of the length of the sound-conducting channel.

15. A loudspeaker apparatus according to claim 1, wherein at least one sound-conducting channel is designed in such a way that sound emerges radially out of the sound outlet opening at an angle of at least 150°.

16. A loudspeaker apparatus according to claim 1, wherein at least one sound-conducting channel is designed in such a way that sound emerges radially out of the sound outlet opening at an angle of at least 180°.

17. A loudspeaker apparatus according to claim 1, wherein at least one sound-conducting channel is designed in such a way that sound emerges radially out of the sound outlet opening at an angle of at least 230°.

18. A loudspeaker apparatus according to claim 1, wherein a limit situated radially on the inside and a limit—situated radially on the outside—of the sound-conducting channel substantially follow the shape of a curve in each case which corresponds to a quarter of the periphery of circle or ellipse.

19. A loudspeaker apparatus according to claim 1, wherein a sound inlet opening of the sound-conducting channel has an internal diameter which corresponds substantially to an external diameter of the loudspeaker and is in indirect contact with the loudspeaker.

20. A loudspeaker apparatus according to claim 1, wherein the loudspeaker apparatus has at least two loudspeakers, wherein at least one radiates the sound vertically upwards at least in part and at least one other radiates the sound vertically downwards at least in part, and said at least two loudspeakers have a sound-conducting channel in the sound radiation direction of the sound generator.

* * * * *